United States Patent [19]

Ciordinik et al.

[11] Patent Number: 4,558,308

[45] Date of Patent: Dec. 10, 1985

[54] INTRUSION WARNING WIRE-LATTICE, AND METHOD AND DEVICE FOR MANUFACTURING SAME

[75] Inventors: Jacques Ciordinik, Bologna; Alessandro Penzo, Crespellano, both of Italy

[73] Assignee: CI.KA.RA. S.p.A., Bologna, Italy

[21] Appl. No.: 174,937

[22] Filed: Aug. 4, 1980

[30] Foreign Application Priority Data

Aug. 7, 1979 [IT] Italy ..... 12710 A/79
Feb. 29, 1980 [IT] Italy ..... 12461 A/80

[51] Int. Cl.[4] ..... G08B 13/12; E21C 29/16
[52] U.S. Cl. ..... 340/550; 254/134.4
[58] Field of Search ..... 340/550; 29/868; 81/3 J, 3 R; 254/134.4

[56] References Cited

U.S. PATENT DOCUMENTS

| | | | |
|---|---|---|---|
| 3,594,770 | 7/1971 | Ham et al. | 340/550 |
| 3,725,891 | 4/1973 | Miller | 340/550 |
| 3,837,624 | 9/1974 | Dandurand | 254/134.4 |
| 3,927,866 | 12/1975 | Linquist | 254/134.4 |
| 4,232,310 | 11/1980 | Wilson | 340/550 |
| 4,234,875 | 11/1980 | Williams | 340/550 |
| 4,293,778 | 10/1981 | Williams | 340/550 |

FOREIGN PATENT DOCUMENTS

| | | | |
|---|---|---|---|
| 475960 | 4/1974 | Australia | 340/550 |
| 2365679 | 4/1978 | France | 340/550 |
| 2038060 | 7/1980 | United Kingdom | 340/550 |
| 2039683 | 8/1980 | United Kingdom | 340/550 |

*Primary Examiner*—Glen R. Swann, III

[57] ABSTRACT

The intrusion warning wire-lattice presents the outer appearance of a normal wire fence, and it has also the same mechanical resistance, but it comprises tubular wires which contain electrical and/or optical conductors connected to a warning system which is responsive to any variation of the capability of conduction of the conductors. The wire lattice comprises a serpentine coil made of tubular wire presenting rectilinear vertical lengths which are connected together by intersecting horizontal wires, among which there are also tubular wires. The fence sections are assembled between hollow box-type posts, at the interior of which there terminate the ends of the tubular wire and there is effected, by means of connectors, the connection between the conductors of each fence section.

6 Claims, 10 Drawing Figures

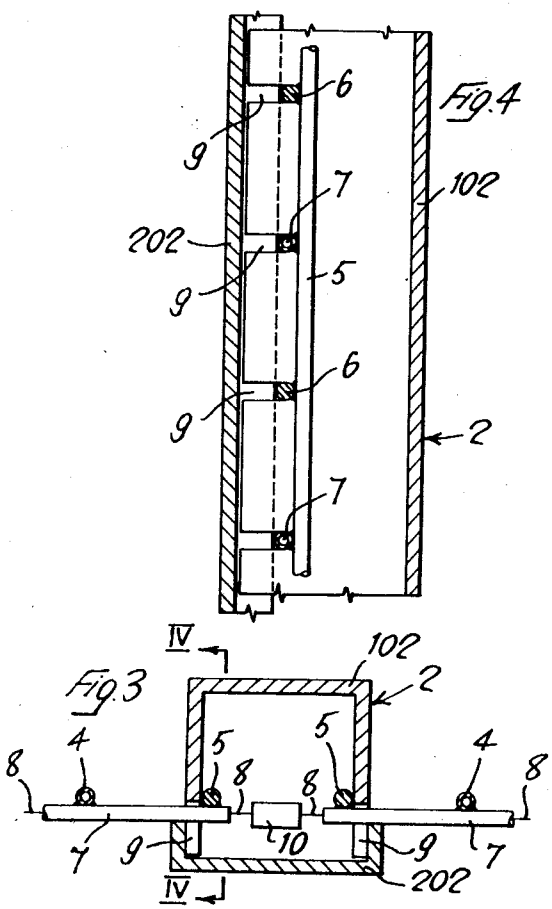
Fig. 4
102
2
6
7
5
6
7
9
202
9
9
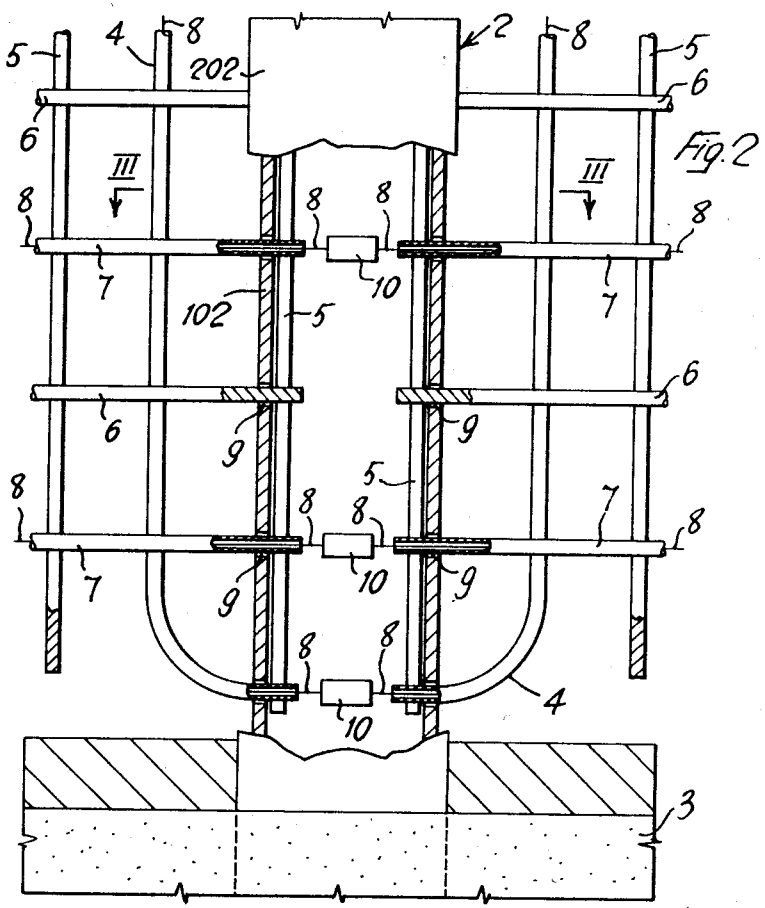
Fig. 2
5
6
8
6
8
III
7
7
8
2
4
3
9
9
10
5
8
10
8
10
8
5
8
8
202
102
9
9
8
4
III
7
6
7
5
6
8
8
8
4
7
102
2
9
202
5
8
10
8
5
IV
IV
9
Fig. 3
4
7
8

X
4
32
31
8
17
33
132
23
8
22
25
26
X
18
29
27
28
30

21
17
20
8
19
22
23
24
21
25
18

INTRUSION WARNING WIRE-LATTICE, AND METHOD AND DEVICE FOR MANUFACTURING SAME

SUMMARY OF THE INVENTION

The present invention has for its object an intrusion warning wire-lattice.

Object of the invention is to realize a wire-lattice of the above mentioned type which consents the signalling, with the highest precision and accuracy, of any attempt of breaking or opening a way through the wire-lattice itself, and which presents at the same time the outer appearance of a normal barrier fence, with possibly the same mechanical characteristics of strength and resistance. The invention further aims to realize a wire-lattice barrier or fence in which the intrusion sensitive means are invisible and not accessible, unless the wire-lattice is at least partially destroyed (thus signalling the intrusion), while at the same time they are perfectly protected against the weather and other external agents. Finally, the invention aims to provide a wire-lattice of the above referred type which can be easily and quickly manufactured and set in place.

According to the invention, the intrusion warning wire-lattice comprises in combination solid (not hollow) wires and hollow, preferably tubular wires having the same outer appearance and, at least apparently, the same function of mechanical barrier as the solid wires, said tubular wires containing at their interior electrical and/or optical conductors (optical fibers) connected to a warning system which is responsive to any variation of the capability of conduction of the said conductors.

The tubular wires can be made of any suitable material, for example metal. They can be made of stainless steel, and more particularly they may consist of small diameter tubes of the so-called BUNDY (Registered Trade Mark) type, obtained by the deformation and union of metal strips, according to processes known in the art. The tubular wires may be zinc-coated, aluminized, plastic coated. They can be even made completely of plastic material, such as fiberglass-reinforced plastic.

According to a preferred embodiment of the invention, the wire-lattice comprises at least a tubular wire containing a conductor (such as optical fiber) and presenting a serpentine coil path, with rectilinear parallel lengths which are arranged horizontally or vertically, and which are connected the one to the other by means of transversally arranged intersecting wires, at least some of the said intersecting wires being also tubular wires containing the conductors. According to a further embodiment, the wire-lattice may comprise two serpentine coils made of tubular wire and presenting their parallel rectilinear lengths which are angularly offset 90° between one another.

Still according to a preferred embodiment of the invention, the intrusion warning wire-lattice is characterized by the feature that it is composite, and more precisely it is composed of a plurality of single prefabricated wire-lattice sections, each section being mounted between two box-type hollow posts in such a manner that the tubular wires forming part of the wire-lattice section terminate at the interior of the box-type posts so that the conductors of two adjoining sections can be connected together at the interior of a common box-type post.

The intrusion warning wire-lattice according to the invention can be manufactured in any suitable manner. The invention however provides for an advantageous method consisting in the feature that the electrical and/or optical conductors are inserted through the tubular wires forming part of the wire-lattice, by providing at one end of the conductor a bead head and by blowing the said bead head, with the conductor secured thereto, through the tubular wire, by using air under pressure.

For the practical realization of the above described method, the invention contemplates also the utilization of a particular pneumatic inserting device of simple construction and operation.

The above and other features of the invention, and the advantages deriving therefrom, will be apparent from the following detailed description of some preferred embodiments, made by way of non-limiting example with reference to the attached drawings.

BRIEF DESCRIPTION OF THE DRAWINGS

FIG. 2 shows in enlarged scale, in elevation with parts in section, the bottom portion of a box-type post with the pertaining sections of the fence according to FIG. 1.

FIG. 3 is a horizontal section of FIG. 2, along line III—III.

FIG. 4 is a partial vertical section of the post according to line IV—IV of FIG. 3.

DESCRIPTION OF SOME PREFERRED EMBODIMENTS

Figure 1:
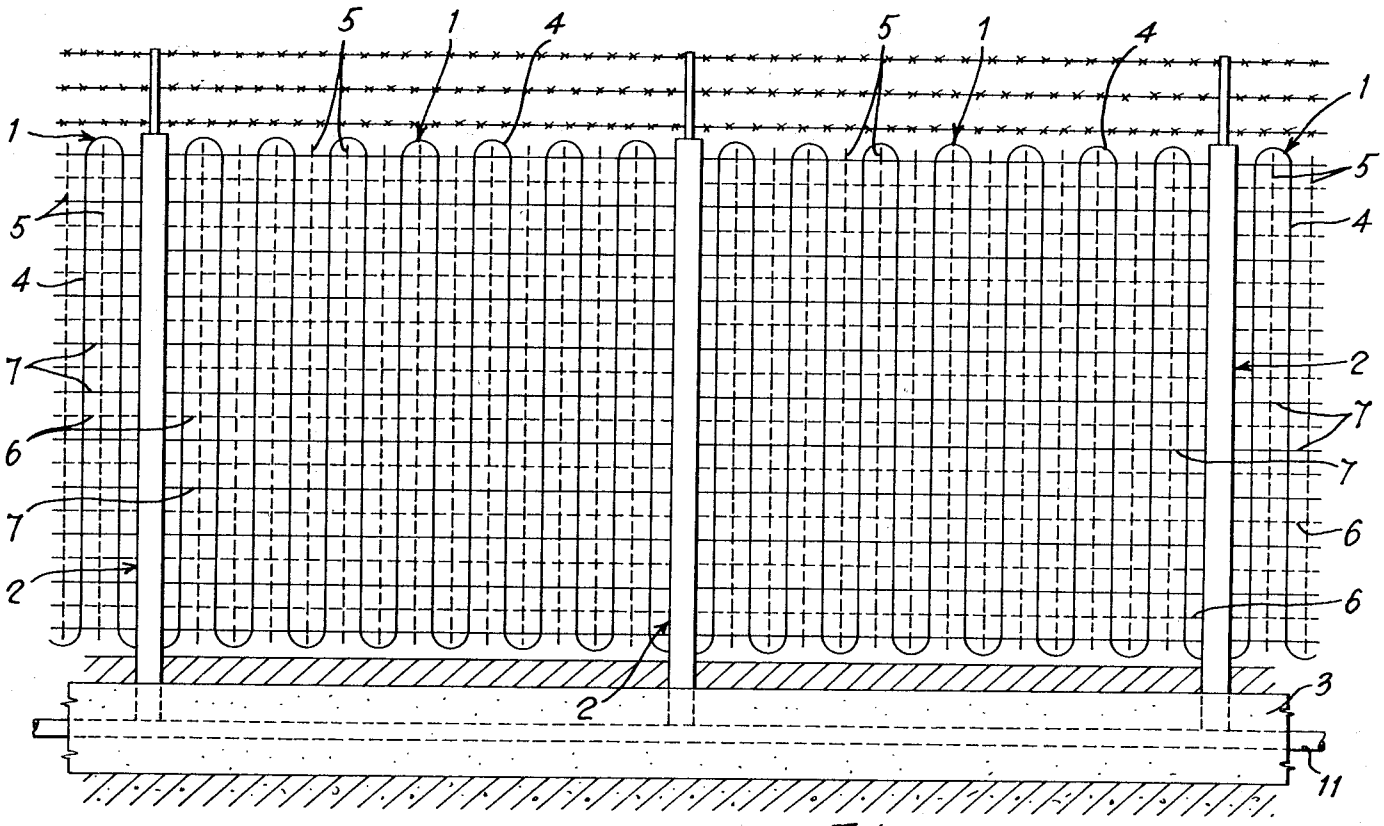
FIG. 1 shows in elevation, with parts in section, an intrusion warning wire-lattice according to the invention, realized as a wire fence.

In the embodiment shown in FIGS. 1 to 4 the intrusion warning wire-lattice is realized as a wire fence consisting of single fence sections 1 equal to one another, and mounted between box-type posts 2 which are secured at predetermined distances on the ground and preferably in a concrete basement 3. Each fence section 1 consists of normal solid (not hollow) wires, indicated by dash lines, and of hollow wires, which are preferably tubular, indicated by full lines. More particularly, each fence section 1 consists of a serpentine coil 4 formed by a continuous tubular wire, the rectilinear parallel lengths of this serpentine coil being directed vertically. Between the vertical rectilinear lengths of the serpentine coil 4 there are arranged vertical normal (not hollow) wires 5. The said vertical normal wires 5 and the vertical lengths of the serpentine coil 4 made of tubular wire, are connected to one another mechanically by means of the horizontal wires 6 and 7, alternately consisting of solid (not hollow) wires 6 and of tubular wires 7. The horizontal wires 6 and 7 are welded, soldered or glued, at the points of intersection, to the vertical wires 5 and to the vertical rectilinear lengths of the serpentine coil 4.

The normal solid wires 5 and 6 and the tubular wires 4, 7, are for example metallic wires and can be zinc-plated, aluminized, plastic-coated, or provided with any other suitable covering or coating, or they can be made of stainless steel. The tubular wires 7 and the tubular wire of the serpentine coil 4 are preferably made of so-called "BUNDY" (Registered Trade Mark) wires, obtained by metal strips deformed to obtain a small diameter tube, and welded or soldered together. Both the normal solid wires 5, 6 and the tubular wire 4, 7 may be of any suitable plastics, even of glass fiber reinforced plastic. Preferably the diameter (outer diameter) of both the solid wires 5, 6 and of the tubular wires 4, 7 is comprised between cm 0.3 and cm 0.5 but, depending on the structure and the size of the fence sections, it can also reach cm 1.0 (one centimeter). The tubular wire of which the serpentine coil 4 is made, and the horizontal tubular wires 7, besides having the same outer appearance and the same function of mechanical barrier as the other solid vertical wires 5 and horizontal wires 6 of the fence, contain each at least one electrical or optical conductor 8, for example optical fibres. The said electrical or optical conductors 8 are connected to a warning or alarm system which is responsive to the breaking and/or deformation, and/or squeezing, and/or compression and/or attacking, and in any case to any variation of the conductive capability of the said conductors 8.

Each fence section 1 is prefabricated and then mounted and secured between two box-type posts 2 which have been previously set in place. In the embodiment shown in FIGS. 2 to 4, each box-type post 2 consists of an upright 102 presenting in transverse horizontal section a U-profile, with its open side preferably directed towards the interior of the protected area and which can be closed by means of side cover 202 fitted thereonto. In the edge portions of the two side walls of the upright 102, in correspondence of its open side, there are obtained horizontal open slits 9 spaced between one another at distances corresponding to the distances between the horizontal wires 6, 7. Upon mounting of the fence, two fence sections 1 are associated to a box-type post by inserting the horizontal wires 6, 7 into the said slits 9, in such a manner that the outermost vertical wire 5 of each fence section 1 is housed at the interior of the box-type post 2, inside which it is introduced through the open side of the upright 102 presenting a U-profile, so that it adheres from the interior against the respective inner side of the wall of the upright 102. The fence sections 1 are then secured to the box-type posts 2 by fitting the side covers 202 over the uprights 102 and by securing the said side covers 202 with the aid of any suitable means (not shown), so as to close the open side of the uprights 102 and the open slits 9. Preferably, the side covers 202 are fitted onto the uprights 102 in a removable manner, so that they can be removed whenever desired with the purpose of consenting the access to the interior of the box-type posts 2.

The horizontal tubular wires 7 and the ends directed horizontally of the serpentine coils 4 terminate at the interior of the box-type posts 2, where the electrical or optical conductors 8 contained in the said tubular wires 7 and 4 are connected the one with the other in any suitable manner, which could be for example by welding or soldering, or by means of suitable connectors 10. In a known manner, at the interior of the posts 2, the conductors 8 may present loose portions, in order to compensate for variations of length consequent to temperature variations, and avoid breaking or stresses on the conductors 8 themselves.

It is to be noted that the adoption of serpentine coils 4 realizes a wire fence in which there are present also vertical wires containing electrical or optical conductors, thus eliminating the need of connector means at the upper and lower extremities of the vertical wire sections. The above described construction of the box-type posts 2 consents a so-called "modular" assembly of the fence and a quick and easy substitution of single fence sections 1. As indicated in FIG. 1, the posts 2 can be put in communication at their bottom with channels or ducts 11 provided in the basement 3, which may contain other electrical or optical conductors forming part of the intrusion warning system.

Figure 5:
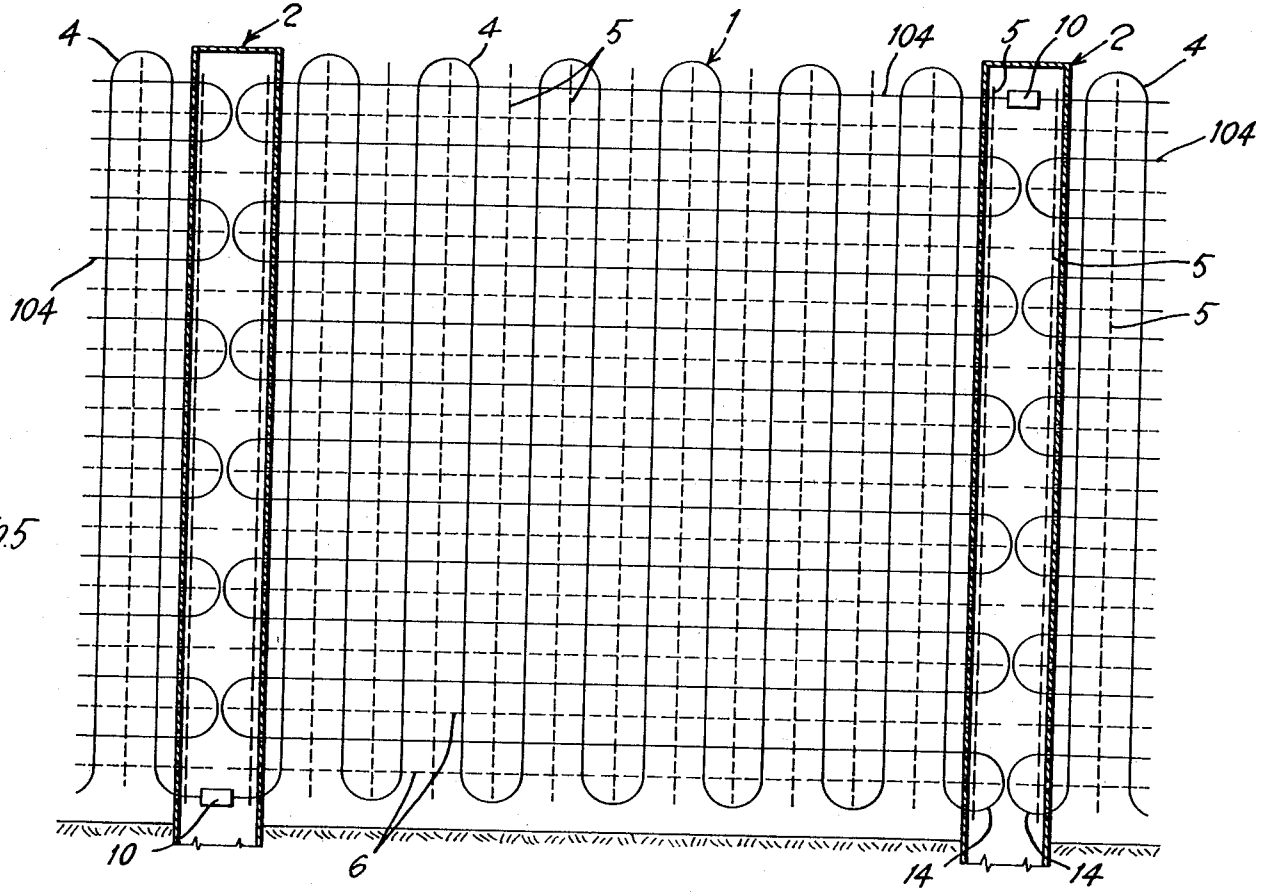
FIG. 5 shows in elevation, with the box-type posts in section, another embodiment of the wire fence according to the invention.

In the embodiment shown in FIG. 5, each fence section 1 is made of two serpentine coils 4, 104 of tubular wire, angularly offset of 90° the one with respect to the other, that is one coil 4 presenting its rectilinear lengths which are vertically arranged, while the other coil 104 presents the rectilinear lengths which are arranged horizontally. The fence section 1 comprises also normal solid wires, vertical and horizontal, 5 and 6, indicated by dash lines. The rectilinear lengths of the serpentine coils 4, 104 and the vertical and horizontal wires 5, 6, are united at their intersection points by welding, soldering or glueing together. The two serpentine coils 4, 104 of the same fence section 1 are connected, in correspondence of their adjoining ends, by means of a junction 14, thus forming a single continuous tubular wire which contains at least one continuous electrical or optical conductor. The fence sections 1 are secured to the box-type posts 2 in the same manner as described in connection with FIGS. 1 to 4, by arranging at the interior of the said posts the loops joining the horizontal lengths of the serpentine coil 104. In the embodiment shown in FIG. 5, it will be necessary to provide only one connector 10 for effecting the connection between the electrical or optical conductor of one fence section 1 and the electrical or optical conductor of the adjoining fence section 1.

The intrusion warning wire-lattice according to the present invention may be embedded in any suitable structure of plastic material or of concrete, or it can be used as support or reinforcement lattice for wall plasterings, and particularly it can be embedded into the structure which defines the strong rooms of banks.

Figure 6:
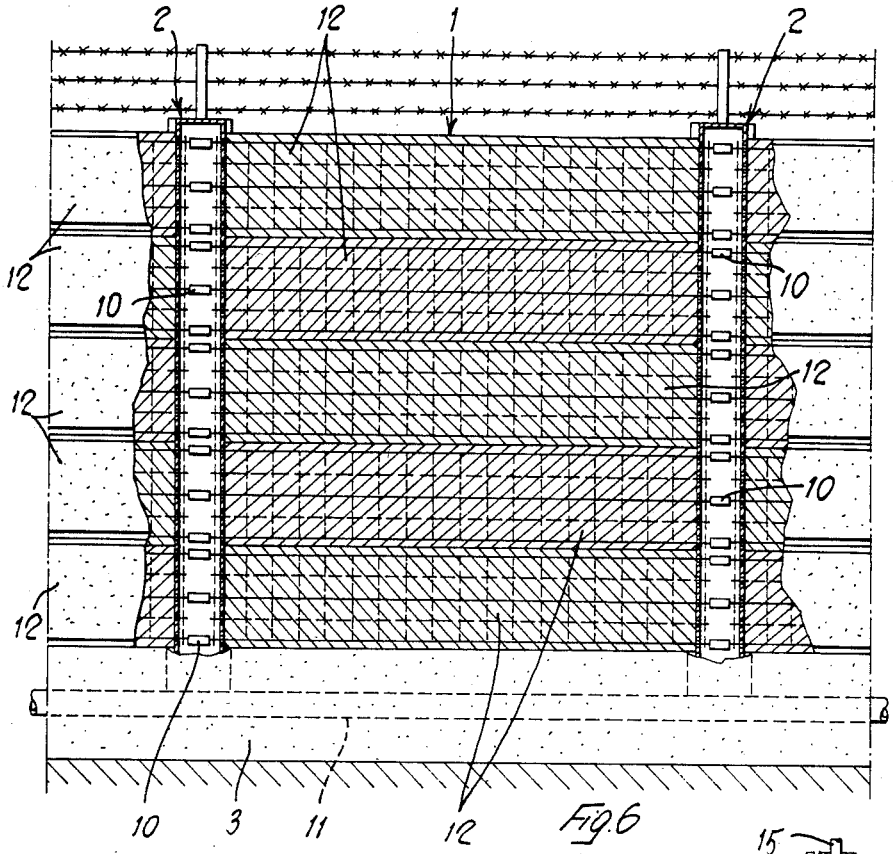
FIG. 6 shows in elevation, with parts in section, an embodiment of a barrier wall obtainable by using the wire-lattice according to the invention.
Figure 8:
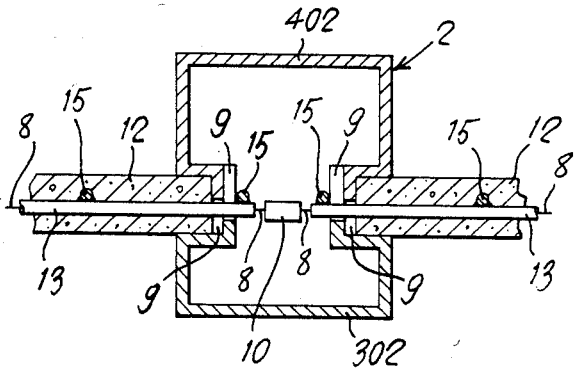
FIG. 8 shows in enlarged scale a transverse section across one of the box-type posts used in the wall according to FIG. 6.
Figure 7:
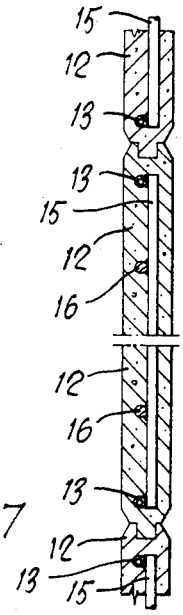
FIG. 7 shows in enlarged scale a vertical transverse section of a portion of the barrier wall according to FIG. 6.

An embodiment showning this type of utilization of the intrusion warning wire-lattice according to the invention is shown in FIGS. 6 to 8 which show a boundary wall consisting of single sections 1 mounted between box-type posts 2. Each wall section 1 is composed of superposed panels 12 connected together by fitting in, as clearly shown in FIG. 7. Each panel 12 is made of concrete, inside which there is embedded the wire-lattice according to the invention, consisting of vertical wires 15 and of horizontal wires 13, 16. The vertical wires 15 and the horizontal wires 16 are normal solid (not hollow) wires, and are indicated by dash lines in FIG. 6, while the horizontal wires 13, indicated by full lines, are constructed as tubular wires each containing at least one electrical or optical conductor 8. The said tubular horizontal wires 13 terminate with their ends at the interior of the box-type posts 2, where there takes place the connection, for example by using connectors 10, of the conductors 8 of the wire-lattices embedded in one panel 12, with the conductors 8 of the wire-lattices embedded in the adjoining panel 12 of two adjoining wall sections 1.

FIG. 8 shows a detail of the construction of the box-type post 2 used for a boundary wall. Each post 2 is formed by two complementary uprights 302, 402 each presenting a U-profile, and which can be fitted the one into the other by their open ends terminating with a step-like profile, so as to realize on each side of the post 2 an outer vertical groove inside which there is fitted the vertical edge of the superposed concrete panels 12. The horizontal tubular wires 13 and also the normal solid wires 16 of the wire-lattice embedded inside the concrete panels 12, preferably project sidewise outwardly of the vertical edges of the panels and penetrate at the interior of the box-type post 2 through slits 9 obtained in the edges of either one or both the uprights 302, 402. The outermost vertical wire 15 of the wire-lattice, which is located in correspondence of the vertical edge of each concrete panel 12 is preferably left out of the concrete and is housed at the interior of the respective box-type post 2. The said posts 2 may be covered, after their assembly, with a watertight coating made of any suitable plastic material, which can be obtained for example by spraying, so as to avoid water leakages and the access of insects to the interior of the box-type posts. In the embodiment shown in FIGS. 6 to 8, the wire-lattice embedded into the concrete panel 12 is advantageously made with matallic wires (both the solid wires 15, 16 and the tubular wires 13) so as to constitute the reinforcement structure of the panel 12.

The single sections 1 of the fence according to FIGS. 1 to 5, as well as the single concrete panels 12 with embedded wire-lattice, are prefabricated and then simply assembled between the box-type posts 2. The electrical and or optical conductors 8 contained at the interior of the tubular wires 7, 13 and in the tubular wire serpentine coils 4, 104, may be inserted through the said tubular wires either before or after the construction of the sections, as well as either before or after the assembly of the single fence sections 1 or wall panels 12. Preferably, for the insertion of the conductor, one end of the said conductor 8 is provided with a small bead head, and this latter is blown through the tubular wire 7 or 13 or through the serpentine coil 4, or through the pair of communicating serpentine coils 4, 104, by means of air under pressure.

Figures 9, 10:
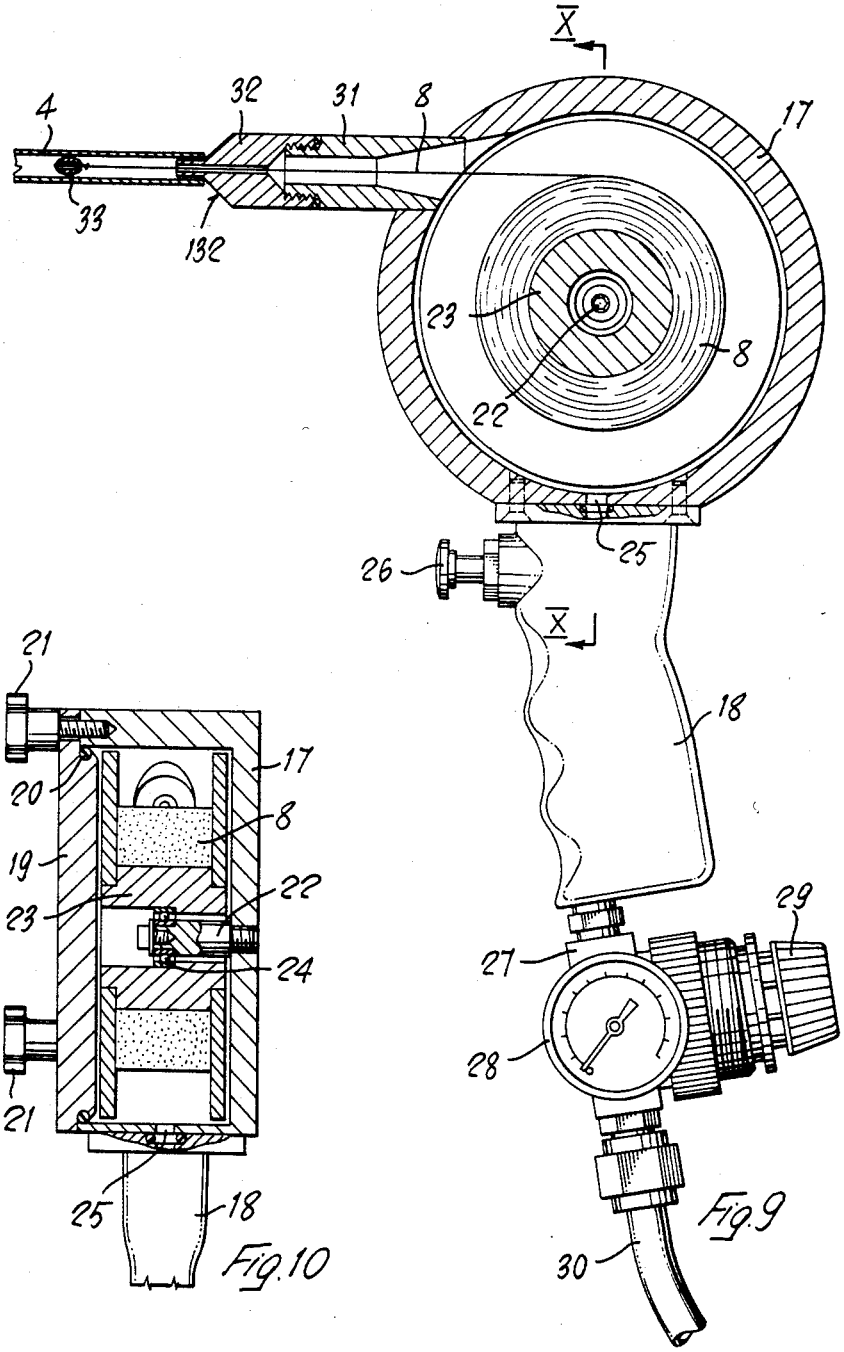
FIG. 9 shows in elevation, with parts in section, a pneumatic inserting device for the manufacture of the wire-lattice according to the invention.
FIG. 10 is a partial section along line X—X of FIG. 9.

In FIGS. 9 and 10 there is illustrated a pneumatic inserting device which can perform the above mentioned pneumatic insertion of the conductor 8.

The pneumatic inserting device consists of a box 17, preferably cylindrical, which is provided with a handle 18 radially departing from same, and with a side cover lid 19 which can be fitted in air tight manner by means of a packing 20 and of screws 21. Usually the box 17 and/or its cover lid 19 are made oftransparent plastic material. Coaxially at the interior of the cylindrical box 17 there projects a pivot 22 which is secured to the bottom of the box 17 and it carries, with the interposition of a bearing 24, a reel 23 onto which there is wound the electrical or optical conductor 8, for example optical fibre. The reel may be taken out of the box after having removed the cover lid 19 and extracted the reel itself from the supporting pivot 22.

In correspondence of the zone of junction of the handle 18 to the box 17, in the lower portion of the said box 17 there opens a through bore 25 for the admission of compressed air. The said bore 25 is connected, through an intercepting valve provided in the handle and controlled by the pushbutton 26, through a pressure reducer 27 provided with manometer 28 and a control knob 29, to a flexible pipe 30 connected to a source of compressed air (not shown).

In its upper section (oppositely to the handle) the box 17 presents a nozzle pipe 32 onto which there can be externally screwed different gauged joints 32 adapted to be introduced into the open end of a tubular wire which constitutes, for example, a serpentine coil 4.

Upon operation of the pneumatic inserting device, to the end of the conductor 8 coming out of the nozzle 31 and gauged joint 32 there is secured a bead head 33 (in the form of a small bead) which is introduced into the tubular wire 4 together with the gauged end of the joint 32 which is compressed, by its conical outer surface 132 against the free end of the tubular wire 4, thus ensuring a sufficient air tightness. Subsequently, the pushbutton 26 is depressed, so that the intercepting valve of the air under pressure is opened. The air under pressure flows into box 15 through bore 25 and flows out through nozzle pipe 31, entering into the tubular wire of the serpentine coil 4. The bead head 33 is thus blown, together with the conductor 8 secured thereto, through the whole length of the tubular wire, until it comes out at the other free end of the said tubular wire (in the present case the serpentine coil 4), thus obtaining the easy and perfect insertion of the conductor, as desired.

Suitable braking means, not shown since they are easily conceivable by a person skilled in the art, may be provided in order to brake the reel 23 synchronously with the interruption of the feeding of air under pressure into the tubular wire, at the end of the insertion operation.

It is believed that the invention will have been clearly understood from the foregoing detailed description of some preferred embodiments. Changes in the details of construction may be resorted to without departing from the spirit of the invention, and it is accordingly intended that no limitation be implied and that the hereto annexed claims be given the broadest interpretation to which the employed language fairly admits.

We claim:

1. A wire-lattice intrusion warning arrangement comprising in combination solid wires and hollow wires having substantially the same outward appearance as the solid wires whereby said hollow wires appear to serve the same mechanical barrier function as the solid wires, said hollow wires including conductive material means located within the hollow interior thereof, and warning system means operatively connected to the conductive material means, said warning system means being responsive to variations in the conductive capability of the conductive material means to thereby give warning of the presence of intruders, said solid and hollow wires forming a plurality of single prefabricated wire-lattice sections, each section being mounted between two box-type hollow posts in a manner enabling the hollow wires forming part of the wire-lattice sections to terminate at the interior of the box-type posts, conductive material means in two adjoining wire-lattice sections being connectable together at the interior of a box-type post.

2. A wire-lattice according to claim 1, wherein each box-type post includes an upright member having two side walls positioned to define a substantially vertical hollow portion or cavity, and a side cover being removably fitted to close said portion or cavity, each side wall of the positioned upright member having a free edge including a series of open slits adapted to receive terminal portions of wires which are horizontally arranged.

3. A wire-lattice according to claim 2, wherein an outermost vertical wire of each wire-lattice section is housed at the interior of the respective box-type post.

4. A wire-lattice according to claim 2, wherein the box-type posts are covered after assembly with the wire-lattice sections with a protective sealant coating of plastic material.

5. A wire-lattice intrusion warning arrangement comprising in combination solid wires and hollow wires having substantially the same outward appearance as the solid wires whereby said hollow wires appear to serve the same mechanical barrier function as the solid wires, said hollow wires including conductive material means located within the hollow interior thereof, and warning system means operatively connected to the conductive material means, said warning system means being responsive to variations in the conductive capability of the conductive material means to thereby give warning of the presence of intruders, said lattice being embedded inside a boundary wall having a plurality of concrete panels which can be fitted superposed the one over the other between two hollow box-type posts, each concrete panel carrying embedded therein a wire-lattice section having hollow wires projecting into the interior of the box-type posts.

6. An intrusion warning wire-lattice system comprising in combination solid wires and hollow wires having substantially the same outward appearance as the solid wires, whereby said hollow wires appear to serve the same mechanical barrier function as the solid wires, said hollow wires including conductive material means located within the hollow interior thereof, means for connecting free ends of corresponding wire lattices in adjacent position to each other, means located substantially externally from the lattice means for containing the connecting means to provide isolation from the external environment to prevent tampering, and warning system means operatively connected to the conductive material means, said warning system means being responsive to variation in the conduction capability of the conductive material means to thereby give warning of the presence of intruders.

* * * * *